United States Patent [19]

Kumar et al.

[11] 4,297,388

[45] Oct. 27, 1981

[54] PROCESS OF MAKING PERMANENT MAGNETS

[75] Inventors: Kaplesh Kumar, Wellesley; Dilip K. Das, Bedford; Ernest C. Wettstein, Acton, all of Mass.

[73] Assignee: The Charles Stark Draper Laboratory, Inc., Cambridge, Mass.

[21] Appl. No.: 138,650

[22] Filed: Apr. 8, 1980

Related U.S. Application Data

[63] Continuation of Ser. No. 957,756, Nov. 6, 1978, abandoned.

[51] Int. Cl.[3] ..... B05D 3/14

[52] U.S. Cl. ..... 427/47; 427/34; 427/132

[58] Field of Search ..... 427/127–132, 427/48, 47, 34

[56] References Cited

PUBLICATIONS

Kumar et al., 2–78 paper #1084 (P 598) Equilibrium and Metastable Samarium–Cobalt Deposits Produced by Arc–Plasma–Spraying, the Charles Stark Draper Lab., Inc., 3rd International Conference.

*Primary Examiner*—Bernard D. Pianalto

*Attorney, Agent, or Firm*—Weingarten, Schurgin & Gagnebin

[57] ABSTRACT

Process and apparatus for forming plasma sprayed high density, high coercivity permanent magnet material and permanent magnets formed therefrom. The plasma sprayed permanent magnet material is obtained in a substantially amorphous state resulting from specifically controlled plasma spray parameters. The amorphous deposition possesses high coercivity, density and potential residual magnetism. The as-sprayed magnetic material is preferably heat treated and then densified to nearly maximum theoretical density. The amorphous structure permits retention of substantially all of the coercivity after heat treatment as well as densification to well over 95% of maximum theoretical density. In addition, magnetic materials, preferably fabricated in accordance with this plasma spraying technique as an amorphous deposit of permanent magnet material, are aligned in a magnetic field and thermally aged to produce permanent magnets in the presence of a thermal gradient or mechanical strain resulting in a high coercivity permanent magnet. Controlled crystalline deposits may also be utilized as the starting material for fabrication of the aligned magnets. The invention has application primarily with the use of permanent magnets formed of rare earth-cobalt alloys and in particular of samarium-cobalt alloys.

3 Claims, 2 Drawing Figures

PROCESS OF MAKING PERMANENT MAGNETS

This is a continuation of Application Ser. No. 957,756, filed Nov. 6, 1978, abandoned.

FIELD OF INVENTION

The present invention relates to the provision of rare earth-cobalt magnets having extremely high retained coercivity values.

BACKGROUND OF THE INVENTION

Permanent magnets formed of rare earth-cobalt alloys have been known for some time and find applications in many areas such as inertial instruments, travelling wave tubes, loudspeakers, DC motors and generators, magnetic bearings, brakes and clutches, as well as actuators and sensors in general. Typical processes for providing such permanent magnets having included sintering of a metallurgical powder of the rare earth cobalt alloy. The sintered product is aligned in a magnetic field and compacted at room temperature. The sintered product is finally densified at elevated temperature to achieve a high density. Such magnets have found substantial applications in industry, but suffer from a loss of magnetic properties during the aligning and densification steps, such as a loss in intrinsic coercivity to a figure at least an order of magnitude below the theoretical maximum. Mechanical strains in the magnet also result from rapid cooling during the treating process used to minimize loss in coercivity which occurs at intermediate temperatures. These degraded magnet characteristics result in low magnetization and poor flux stabilities in the magnets, thereby impairing their values in many of the applications noted above.

BRIEF SUMMARY OF THE INVENTION

In accordance with the teaching of the present invention, permanent magnet material and a permanent magnet formed thereof are provided in which high intrinsic coercivity is achieved and maintained throughout the treatment process along with a high remanence. Also a superior, substantially maximum density is obtained. These improvements all result in high strength magnets with greater flux stability.

The magnetic material is formed by plasma spraying of a fine, uniform particle size powder of a rare earth-cobalt alloy such as samarium-cobalt onto a controlled temperature substrate. At low substrate temperatures the homogeneous particulate plasma spray results in a uniformly liquid deposition which is rapidly quenched to a substantially amorphous, non-crystalline state that avoids large grain sizes characteristic of prior art magnetic materials which have exhibited relatively low coercivity.

Maintenance of plasma gun to substrate distance as well as particulate grain size is significant in insuring a homogeneous small grain size deposition as opposed to the relatively larger grain size characteristic in prior art magnetic materials formed by sintering or other spray techniques. In order to provide uniform deposition quality with increasing deposit thickness, a variable spray rate is employed to overcome the increasing thermal impedance with increasing deposition thickness.

The deposit thus formed may be hardened or crystallized at relatively low temperatures without the loss in coercivity resulting from traversing an intermediate temperature range, during cooling subsequent to the heat treatment. Densification is then preferably provided using one of a number of processes, the preferred one of which is a hot isostatic process employing a high environmental gas pressure without the normal mechanical containment employed in such densification. The resulting magnet has an extremely high residual intrinsic coercivity with a densification which can be made substantially greater than 95% theoretical maximum, indeed approaching 100% density.

The amorphous deposit provided by the plasma spray process also provides an ideal and preferred material for producing an aligned permanent magnet. The amorphous substrate is placed in a magnetic field and heated to a relatively low temperature while a mechanical stress or thermal gradient is applied to the material. The resulting magnetic material can also be hot isostatically processed to a close to 100% density figure to produce a material of extremely high magnetization and flux stability.

DESCRIPTION OF THE DRAWING

These and other features of the present invention are more fully set forth below in the solely exemplary detailed description of the invention and accompanying drawing of which.

DETAILED DESCRIPTION OF THE INVENTION

The present invention contemplates permanent magnet material and permanent magnets formed therefrom wherein the problems of loss in intrinsic coercivity during processing of a rare earth-cobalt deposition are avoided and in which a well defined grain structure of isotropic and aligned magnetic material is provided. The resulting material or magnet exhibits a high degree of flux stability in magnetic strength which may be further increased by densification to near 100% theoretical maximum density permitted by the very homogeneous material initial deposition structure.

Figure 1:
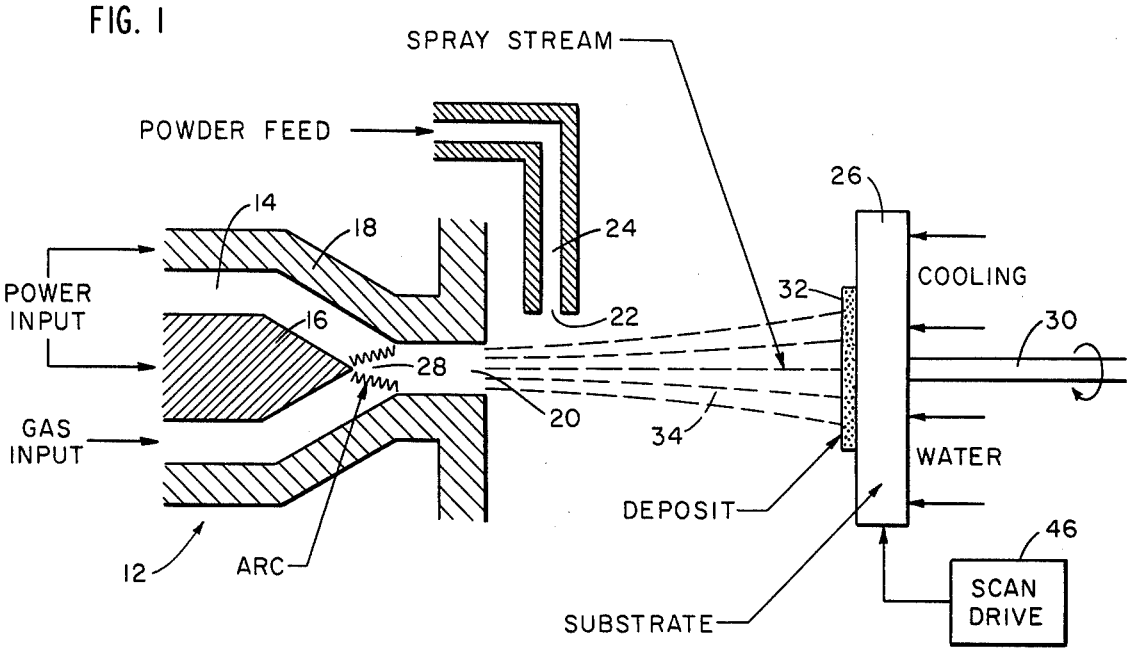
FIG. 1 is a view of apparatus useful in producing plasma sprayed depositions in accordance with the present invention.

Apparatus for providing crystalline and amorphous deposits of a rare earth-cobalt typically from a samarium-cobalt deposition is illustrated in FIG. 1 shown there is a plasma flame gun 12, such as a commercially available 40 kW Metco 3MB plasma spray gun. The gun includes an annular gas feed conduit 14 surrounding a central electrode 16 with the conduit 14 in turn surrounded by an external electrode 18. The conduit 14 terminates in an orifice 20 between extensions of the exterior electrode 18. Directly beyond the orifice 20 is placed an orifice 22 for a conduit 24 of powdered rare earth-cobalt alloy to be depositied onto a substrate 26 set at a temperature controlled within a range of −196° C. to 700° C. located a predetermined distance from the orifice 20 of the plasma spray gun. The application of a voltage between the electrode 16 and 18 causes an arc discharge in a region 28 of the plasma gun which ionizes gas flowing through the conduit 14, permitting it to be accelerated toward the substrate 26 using conventional electrical biasing techniques. The gas input is typically an ionizable inert gas such as argon and/or helium. In the case of samarium cobalt in either the form $SmCO_5$ or $Sm_2Co_{17}$, a uniform, extremely fine particle size for the alloy powder is desired using conventional screening techniques. Preferably a particle size of 40 plus or minus 20 microns diameter is employed with an orifice 20 to substrate 26 distance of approximately 2–20 cm. Particle sizes of 10–100 microns may be used.

The substrate 26 is preferably of graphite or copper material and typically rotates at a few hundred revolutions per minute on a shaft 30. The substrate 26 is also cooled, as for example by the application of cooling water to the rear surface thereof. This insures that as a deposit layer 32 forms on the surface of the substrate 26 facing the orifice 20 a substantially uniform deposit occurs. For amorphous material deposition the substrate 26 is preferably maintained at a temperature well below the crystallization temperature for the samarium-cobalt powder, approximately 500° C. The substrate 26 may alternately be heated by a heating system to provide a controlled crystallizing deposit by maintaining a unidirectional heat flow to or from the substrate.

The combination of a fine particulate powder of uniform particle size, which results in a uniformly liquid particle state in the heated plasma flame 34 issuing from the orifice 20, with cooling of the substrate 26 to maintain the deposit substantially below the crystallization temperature for samarium cobalt, results in a substantially non-crystalline, substantially amorphous deposit 32 characterized by a metastable state.

Figure 2:
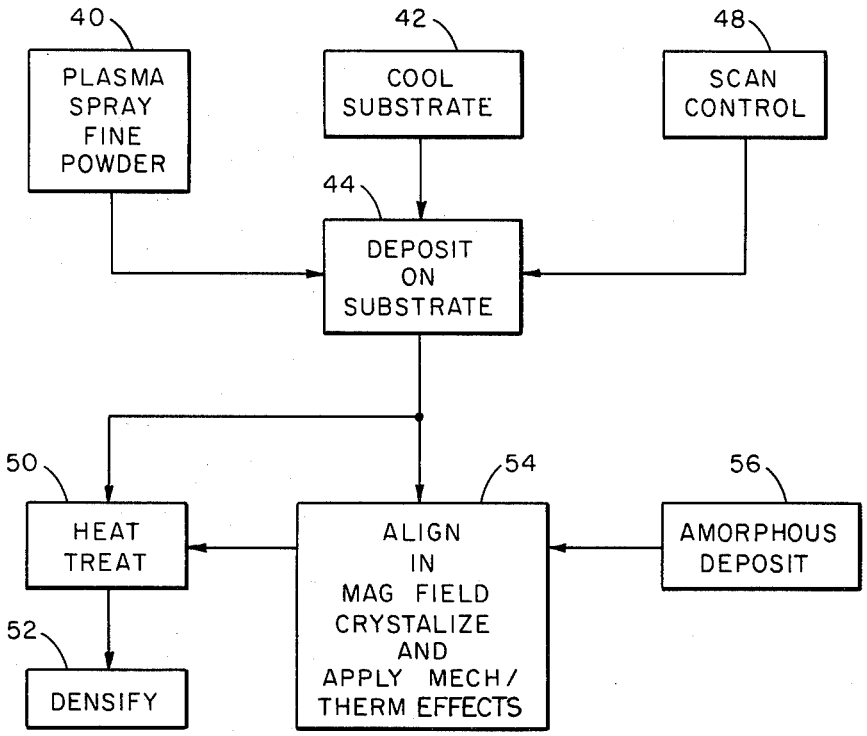
FIG. 2 is a processing diagram illustrative of the processing in preparing a permanent magnet material and permanent magnet in accordance with the present invention.

The process yielding the deposition is illustrated in the flow diagram of FIG. 2 as comprising a simultaneous fine powder plasma spray step 40 and substrate cooling (or heating as noted above) step 42 resulting in the depositing of layer 32 with these characteristics in a subsequent step 44. A scan drive 46 is illustrated in FIG. 1 to move the substrate 26 across the plasma flame 34 to increase the surface area of the deposition and thereby reduce the deposition rate. This scan drive is utilized as an optional control over the deposition so as to slow the deposit rate as the layer 32 builds. This control is utilized to compensate for the increasing thermal impedance from the surface of the layer 32 with its increasing thickness so that a temperature rise does not occur above the desired levels for producing an amorphous deposition. Accordingly a scan control step 48 is optionally provided in FIG. 2 to gradually increase the amplitude of scanning as the layer 32 grows. Additional cooling can be applied to the substrate 26 to accomplish or augment this same objective.

The deposit thus formed provides some advantageous magnetic material properties resulting from the amorphous characteristic of its microstructure. Primary among these is an extremely high intrinsic coercivity. This high coercivity becomes particularly large after a preferred homogenization step 50 in which the deposition is heated to a temperature above 800° C. typically in the range of 900° C. to 1050° C. Experimentally observed coercivities of 67 kOe have been found to result from exposures within this range for two to four hours in a conventional heat treating chamber having an atmosphere of argon at a pressure of 5 psi. Coercivities above 40 kOe are regularly achieved. By contrast to former deposits, the plasma sprayed deposit of the present invention is also characterized by a high density resulting from a reduction in oxygen content and to a more uniform deposition resulting from the control over particle size and liquification homogeneity as the particles strike the substrate. This density is preferably further increased in a densification step 52 in which the deposit is exposed to a hot isostatic pressing operation, typically carried out at a temperature of 900° C. in an argon gas environment pressurized to 15,000 psi. Preferably the isostatic pressing operation is conducted without the deposit being placed in a conventional metal can. The resulting densification exceeds 95% theoretical maximum density and may be made to reach 99% of theoretical maximum or higher. In the later case, the process to achieve this level of densification consisted of not isostatically pressing the material after exposing it for two hours at 1050° C. followed by a four hour aging at 900° C. and a rapid cooling to room temperature (for example within five minutes).

The resulting high density of the magnetic material improves its potential permanent magnet strength as well as its flux stability which normally degrades significantly with reducing densities.

To produce an aligned permanent magnet from the amorphous material of the present invention, an alignment step 54 is placed in the process before the heat treating step 50. While it is preferred that an amorphous, high quality uniform deposition produced in accordance with steps 40–44 be employed as a starting point it is to be recognized that other processes 56 for generating a similar amorphous or controlled crystalline state may be utilized. The deposition step may therefore include deposition of a rare earth-cobalt alloy at a controlled temperature in the range of −196° C. to 700° C., maintaining a unidirectional heat flow to or from the substrate. The alignment step 54 consists of placing the deposition layer 32 in a magnetic field in the range of 1–150 kOe, for example of 100 kOe, intensity and heating the material to a temperature within the range of 400° C.–700° C. for a period such as four hours. In addition, the deposition layer 32 is subjected to thermal or mechanical forces as by the application of a thermal gradient or mechanical tensile or compressive force during the alignment process. The alignment step is preferably practiced in an argon atmosphere having a pressure of 1–5 psi.

Materials other than samarium may be employed in the production of magnets according to this technique. These include misch-metal, cerium and praseodymium as well as some other rare earths.

A permanent magnet formed in accordance with this technique exhibits not only a high coercivity but a high magnetic remanence and flux stability producing a strong, reliable permanent magnet for many applications requiring strong but small permanent magnets.

The above description is intended as exemplary only, the actual scope of the invention being as defined in the following claims.

What is claimed is:

1. A process for producing permanent magnet alloy material comprising the steps of:

directing a spray of a molten particulate rare earth-cobalt alloy toward a substrate;

depositing said molten particulate alloy on said substrate; and controlling the substrate temperature to a temperature below the crystallization temperature of said alloy during deposition to produce a substantially amorphous state deposition for said alloy.

2. The process of claim 1 adapted for producing a rare earth-alloy permanent magnet material comprising the step of:

aligning said deposition in a magnetic field at a predetermined temperature for a predetermined period of time.

3. A process for producing aligned permanent magnets comprising the steps of:

depositing molten particulate rare earth-cobalt alloy magnet material on a substrate in a crystalline state.

controlling the temperature of said substrate during deposition to provide a unidirectional heat flow across the deposit of magnet material; and magnetically aligning said material.

* * * * *